US007748869B2

(12) United States Patent
Sevack et al.

(10) Patent No.: US 7,748,869 B2
(45) Date of Patent: Jul. 6, 2010

(54) RECESSED LIGHTING FIXTURES WITH PROJECTOR ACCESSORY

(75) Inventors: Lauren Sevack, Dollard Des Ormeaux (CA); Lloyd Sevack, Dollard Des Ormeaux (CA); Mario Viscusi, Laval (CA); Costa Dampollas, LaSalle (CA); Eric Demers, Montreal (CA); Julius Posch, Dollard-des-Ormeaux (CA)

(73) Assignee: Tripar, Inc., Montreal, Quebec (CA)

( * ) Notice: Subject to any disclaimer, the term of this patent is extended or adjusted under 35 U.S.C. 154(b) by 369 days.

(21) Appl. No.: 11/713,327

(22) Filed: Mar. 2, 2007

(65) Prior Publication Data

US 2007/0211475 A1 Sep. 13, 2007

Related U.S. Application Data

(60) Provisional application No. 60/779,973, filed on Mar. 8, 2006.

(51) Int. Cl.
*F21S 8/04* (2006.01)
*F21V 21/14* (2006.01)
*F21V 17/06* (2006.01)

(52) U.S. Cl. ..... 362/277; 362/311.13; 362/398; 362/449; 362/455

(58) Field of Classification Search ..... 362/277, 362/311.13, 396, 398, 449, 455, 456
See application file for complete search history.

(56) References Cited

U.S. PATENT DOCUMENTS

| | | | | | |
|---|---|---|---|---|---|
| 1,683,599 | A * | 9/1928 | Berry | 362/311.09 |
| 2,478,336 | A * | 8/1949 | Stein et al. | 362/253 |
| 2,802,933 | A * | 8/1957 | Broadwin | 362/366 |
| 3,040,172 | A * | 6/1962 | Kingsley | 362/257 |
| 3,518,420 | A * | 6/1970 | Kripp | 362/257 |
| 3,683,173 | A * | 8/1972 | Guth, Jr. | 362/366 |
| 4,475,147 | A * | 10/1984 | Kristofek | 362/148 |
| 5,303,125 | A * | 4/1994 | Miller | 362/554 |
| 5,836,678 | A * | 11/1998 | Wright et al. | 362/364 |
| 6,113,252 | A | 9/2000 | Arlitt et al. | |
| 7,399,104 | B2 * | 7/2008 | Rappaport | 362/365 |
| 7,470,048 | B2 * | 12/2008 | Wu | 362/364 |
| 2002/0172047 | A1 * | 11/2002 | Ashley | 362/364 |
| 2003/0063467 | A1 * | 4/2003 | Grajetzky et al. | 362/296 |

* cited by examiner

*Primary Examiner*—Ismael Negron
(74) *Attorney, Agent, or Firm*—Alfred M. Walker

(57) ABSTRACT

A recessed lighting fixture includes a trim member and a light projector accessory having one or more lenses, one or more gobos including an image to be projected, a suitable attachment for the accessory to be attached to the recessed light fixture, and a focusing mechanism for focusing the image projected from the gobo.

13 Claims, 8 Drawing Sheets

RECESSED LIGHTING FIXTURES WITH PROJECTOR ACCESSORY

RELATED APPLICATIONS:

This application claims benefit under 35 U.S.C. Section 119 (e) of provisional patent application No. 60/779,973 filed Mar. 8, 2006.

FIELD OF THE INVENTION

The present invention relates to a light projector accessory for recessed lighting fixtures.

BACKGROUND OF THE INVENTION

The art of using a "gobo", which is a thin metal template disk with cutout patterns or etched glass, to project light patterns on surfaces, is well known. Electric light fixtures incorporating gobos to project onto vertical or horizontal surfaces of walls, floors, table-tops, etc. have been commercially available. In addition, U.S. Pat. No. 6,113,252 of Arlitt describes a variety of embodiments of architectural luminaires with this capability as well.

The prior art does not describe an inexpensive projector accessory using, as a light source, an existing recessed lighting fixture.

OBJECTS OF THE INVENTION

It is therefore an object of the present invention to provide a light projector accessory for recessed lighting fixtures.

Other objects which become apparent from the following description of the present invention.

SUMMARY OF THE INVENTION

The invention is a projector accessory that can be mounted on existing recessed lighting fixtures. It is light enough to clip onto or to be magnetically attached to trims without pulling them out. This invention is economical since it is almost entirely made out of stamped metal parts. It is compact since the light source is already contained in the existing recessed lighting fixture.

The light projector accessory is used in combination with a recessed lighting fixture. The accessory includes one or more lenses, one or more gobo templates, a suitable attachment for the accessory to be attached to a recessed light fixture, and a focusing mechanism for the projected image.

The preferred embodiment of the projector accessory is designed to clip onto lighting fixture trims, such as, for example, 4 inch to 5.5 inch round recessed lighting trims or to 4 inch to 4.5 inch square trims. The springs make it easy to clip the projector onto the recessed trim without modifying the installation or damaging it. While other light sources may apply, the preferred light source is a 50 W MR16 or GU10 halogen bulb in the recessed lighting fixture.

A base, such as a round base, or a base of any other geometric configuration, is the part closest to the recessed lighting trim and is the part to which the attachments, such as, for example, springs or other fasteners, (preferably three or more) are attached. Optional holes around the periphery of the horizontal lower member of the base permit a variable amount of ambient light to filter through as adjusted by a diaphragm. A gobo holder, such as, for example, a gobo holder tube, is attached to the lower extension of the base by a bayonet system to permit quick disassembly for changing a gobo to project a different image. Optionally, the gobo holder may be provided integrally incorporated into the base, making the gobo holder and base a single piece. The gobo holder holds the gobo, preferably with spring elements around its periphery, which may be a tube formed by a die which impinge on the inside of the lens holder, such as a lens tube holding the lens, permitting it to be adjusted up and down to focus the image and then holding its position by friction. An optional retainer, such as a loop of light weight nylon cord, is engaged with the lens tube and with one or more of the fasteners, such as attachment springs, to insure against accidental dropping of the projector accessory.

An optional mirror in the form of a polished oval surface allows projection at different angles onto wall or floor or table-tops. It projects the light beam emanating from the lens at the bottom of the lens tube at the desired angle which is set by bending the attachment arm. The distal end of the arm preferably has a suitable mirror attachment, such as, for example, a magnet and a high friction pad, which attaches the mirror adjacent to the lens tube adjacent to the distal end.

The projector accessory is preferably sold as a kit including three primary color filters, a lens, and a variety of gobos. The color filters can be used singly or in combination to form colors such as orange, purple, or green, or they can be left out altogether. The kit is available with a short wide angle lens tube or with a longer narrow angle lens tube for projecting images at greater distances.

A lens retainer composed preferably of piano wire shaped in triangle fashion prevents the lens from falling by exerting force against the walls of the lens tube when compressed. The retainer design makes it easy to remove the lens and add color filters.

In an alternate embodiment, a post is used to mount the gobo as well as the lens. The post is mounted to the recess light fixture with mechanical fasteners, or by a strong magnet attracted to the trim and attached to the end of the post. Both the gobo and lens are attached to the post on separate arms which can be positioned by sliding up or down the post; this facilitates focus adjustment.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION OF THE INVENTION

Figure 1:
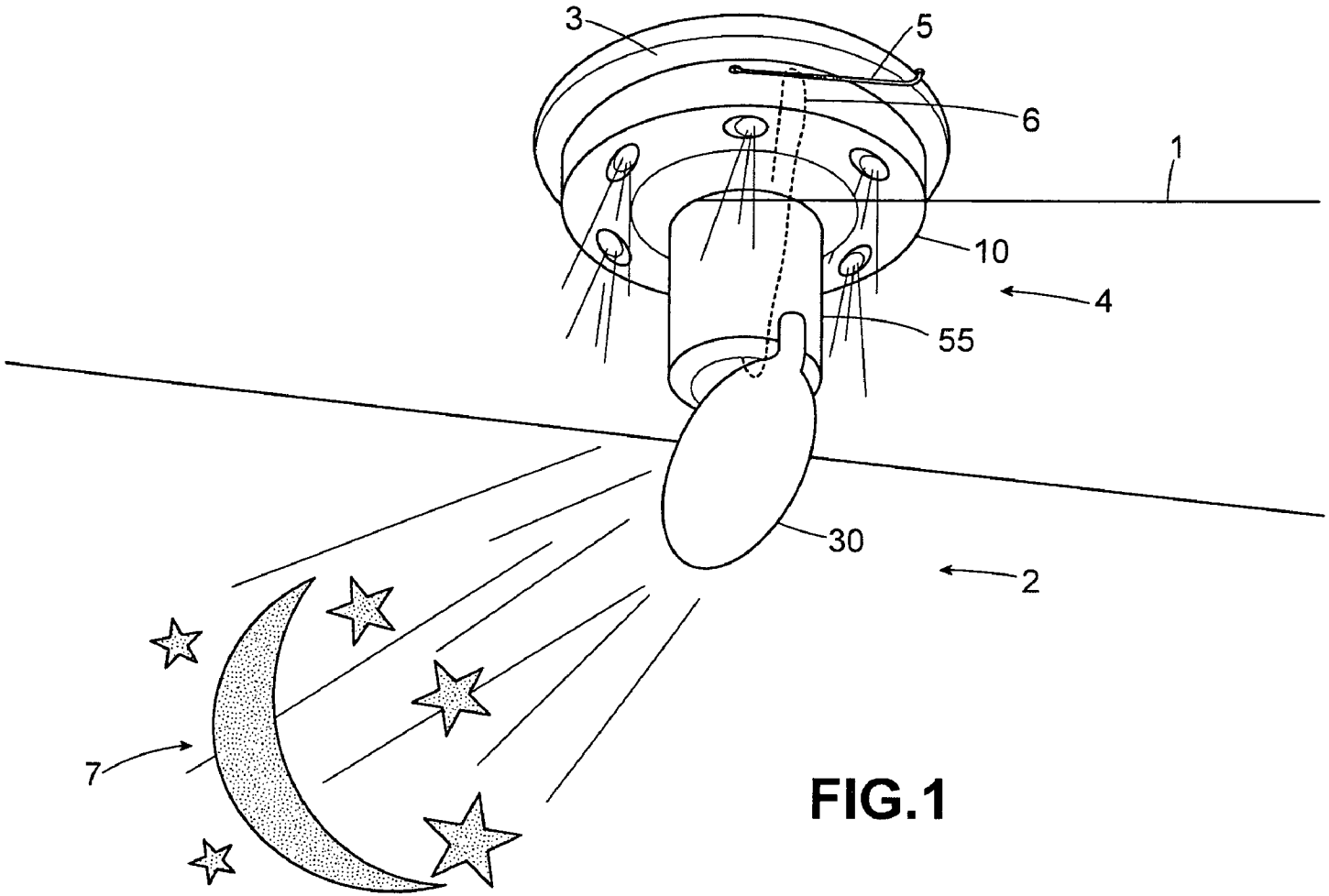
FIG. 1 is a perspective view of the projection accessory of this invention attached to an existing recessed lighting fixture and, in use, projecting a pattern onto a wall.

Although separate parts of this projection accessory are illustrated in the following drawings, FIG. 1 shows a complete projector accessory 4 attached to a round trim 3 of a recessed lighting fixture mounted in ceiling 1 by one of three or more attachment springs 5. An image 7 is projected onto wall 2 by reflection on mirror 30. A safety line 6 shown as a dashed line is looped through lens tube 55 and spring 5. It can be nylon monofilament or similar flexible small diameter material to insure that the lens tube would not fall to the floor if inadvertently loosened.

Figure 3:
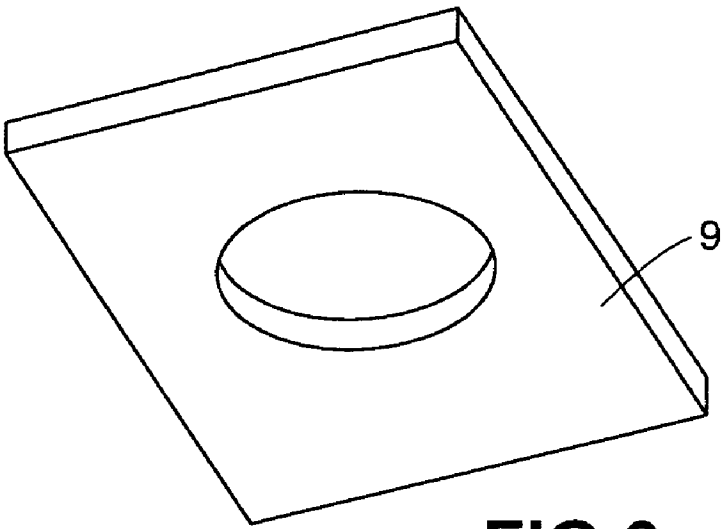
FIG.3 PRIOR ART
FIG. 3 is a perspective view of a square trim from a recessed lighting fixture.
Figure 2:
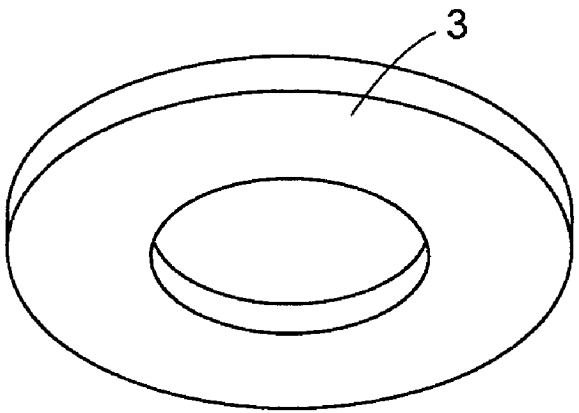
FIG.2 PRIOR ART
FIG. 2 is a perspective view of a round trim from a recessed lighting fixture.

FIGS. 2 and 3 show round trim 3 and square trim 9 which may be found on typical recessed lighting fixtures. Both types can be accommodated as attachment targets for the projector accessory of this invention.

Figure 4:
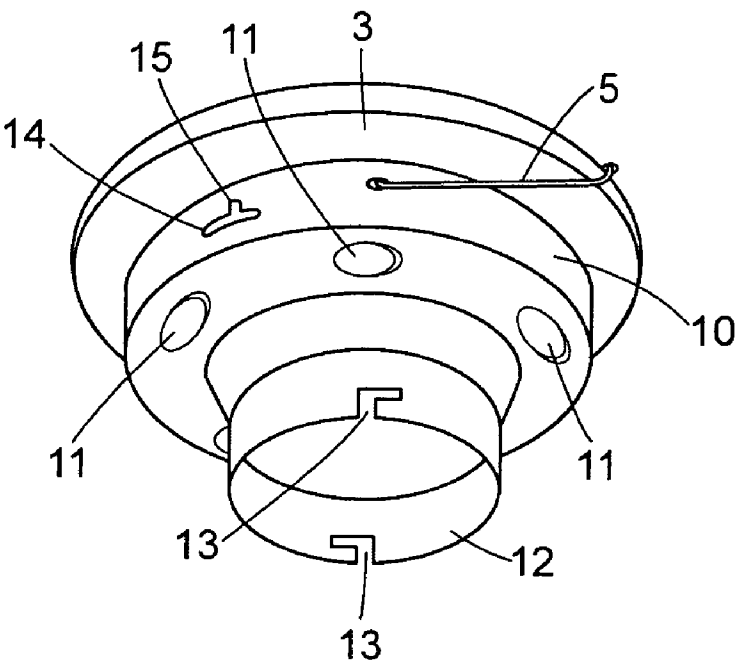
FIG. 4 is a perspective view of the base of the projector attached to a round trim.

FIG. 4 shows the base 10 attached to trim 3 by springs 5. Holes 11 leak an adjustable amount of ambient light into the room space as adjusted by an internal diaphragm with adjusting handle 15 protruding from slot 14. Base 10 necks down into attachment collar 12 with slots 13 which form one part of the bayonet attachment for the tubular gobo holder 45 of FIG. 12.

Optionally, the gobo holder 45 may be provided integrally incorporated into the base 10, making the gobo holder 45 and base 10 a single piece.

The light projector accessory 4 is used in combination with a trim 3 of a recessed lighting fixture. The accessory 4 includes one or more lenses 24, one or more gobos 20, a suitable attachment for the accessory 4 to be attached to a recessed light fixture, and a focusing mechanism for focusing the projected image 7 through at least one lens 24.

Figure 5:
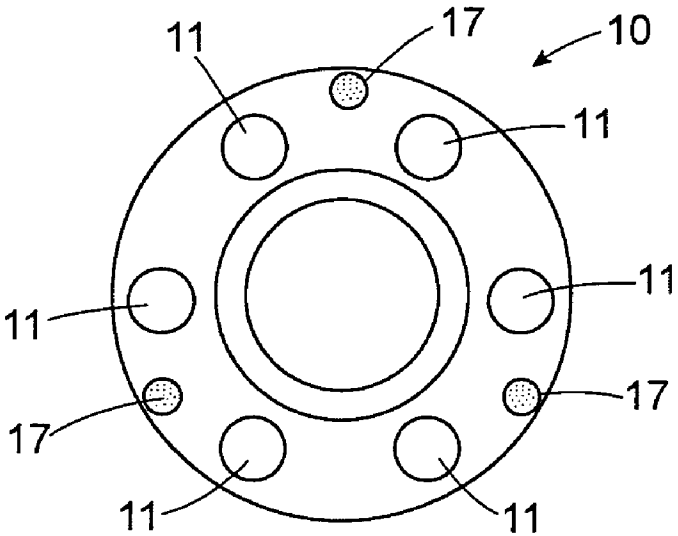
FIG. 5 is a top inside plan view of the base of FIG. 4.

In the top internal plan view of FIG. 5, magnets, such as three magnets 17, are shown attached internally on the vertical wall section of base 10. These are an alternative to springs 5 as an attachment method to trim 3 or 9. Obviously, magnets 17 can be attached externally instead; they can also be rectangular instead of round in crossection.

Figure 6:
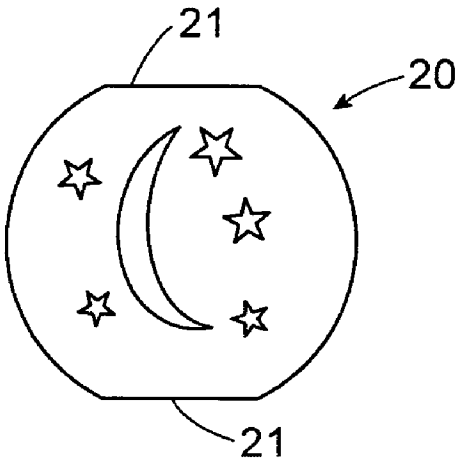
FIG. 6 is a top plan view of a typical gobo.

FIG. 6 shows a typical gobo 20 with decorative cutout. These are available in many standard designs, or they can be custom fabricated out of thin metal or glass disks. Flats 21 are optional, but they serve to make installation in gobo holder 45 easier by providing clearance for lanced indentations 47 which engage slots 13 on base collar 12.

Figure 7:
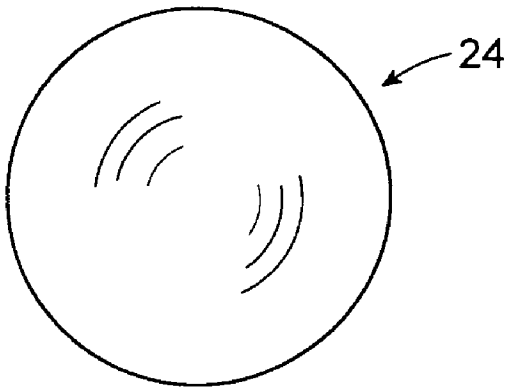
FIG. 7 is a top plan view of a lens.
Figure 13:
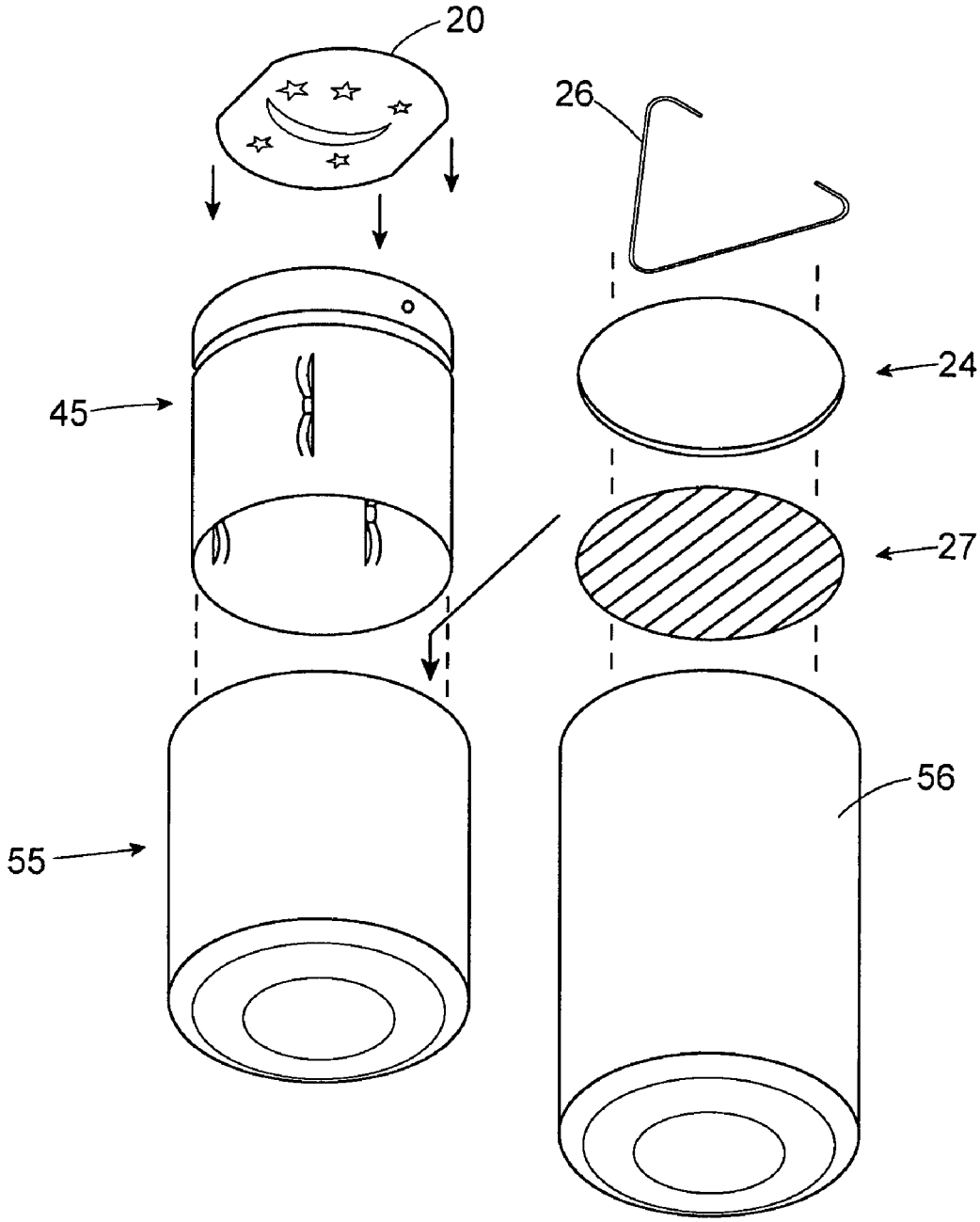
FIG. 13 is a perspective exploded view of a portion of the projector accessory including a gobo, gobo holder tube, lens retainer, lens, filter, and lens tube (two sizes shown)

FIG. 7 shows lens 24 which is placed in the end of lens tube 55 or 56 (see FIG. 13). Note that lens 24 may be of different focal lengths in order to change the projection angle.

Figure 8:
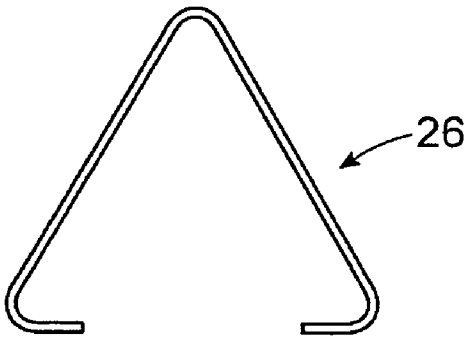
FIG. 8 is a top plan view of a wire lens retainer of this invention.

Wire lens retainer 26 (shown in FIG. 8) is a spring member which holds lens 24 in place within short lens tube 55 or longer lens tube 56. Retainer 26 could alternately be a slotted washer or tubular section which would compress slightly when entering short lens tube 55 or longer lens tube 56, similarly holding lens 24.

Figure 9:
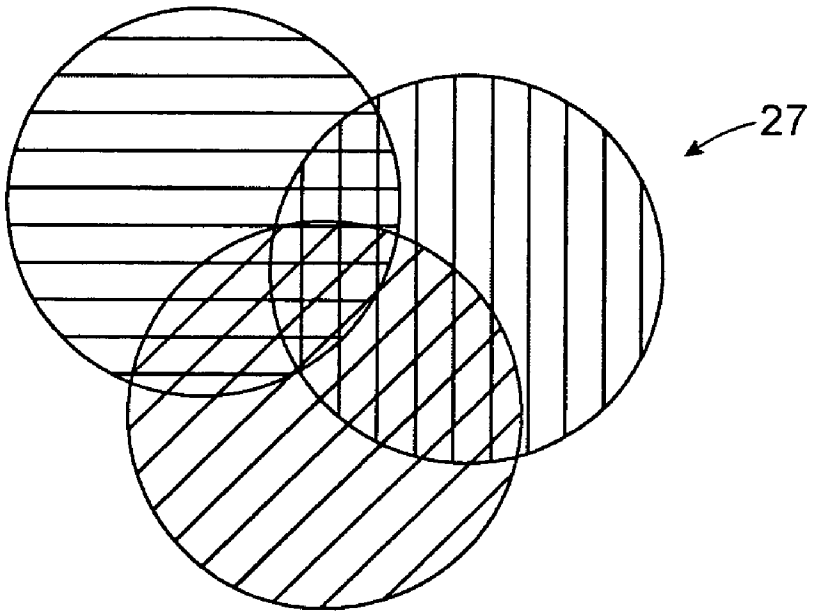
FIG. 9 is a top plan view of a set of three color filters.

Three primary color filters 27 are shown in FIG. 9. They can be used singly or in pairs to color the image projected out of lens 24.

Figure 10:
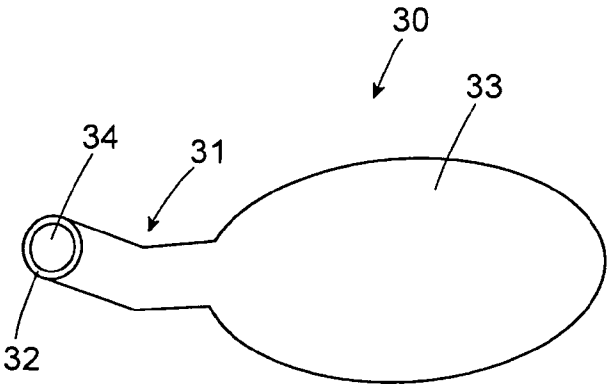
FIG. 10 is a perspective view of the mirror.

FIG. 10 shows mirror 30 with attachment extension 31 and attachment magnet 32 which attaches it to the end of lens tube 55 or 56 as shown in FIG. 1. A thin high friction disc 34, is bonded onto the exposed face of magnet 32, serving to better stabilize mirror 30 when it is placed against lens tube 55 or 56.

Figure 11:
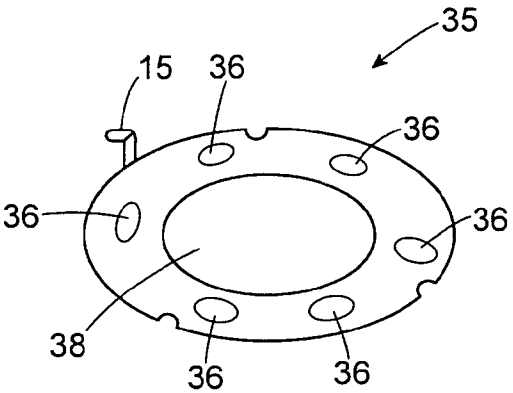
FIG. 11 is a perspective view of the diaphragm which fits inside the base to facilitate control of ambient light escaping from the recessed lighting fixture to which the projection element is attached.

FIG. 11 shows diaphragm 35 which fits within base 10 and is rotated by adjustment handle 15 so that holes 36 are placed in various degrees of registration with holes 11 to control the ambient light escaping from zero to a maximum.

Figure 12:
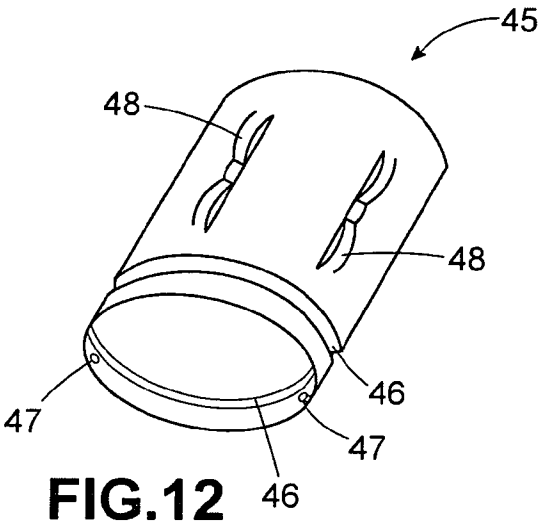
FIG. 12 is a perspective view of the gobo holder tube which also is the attachment for the lens tube.

FIG. 12 is the gobo holder 45; it is sized to fit over collar 12 in base 10. Lanced indentations 47 fit in slots 13 to constitute a quick bayonet attachment of the two members. Ring 46 is pressed into the wall of holder 45 to create a resting edge for gobo 20. Spring members 48 are lanced and formed to bulge outward from the wall of holder 45. Lens tube 55 or 56 is sized to slip over the lower distal end of an installed gobo holder 45 and to engage spring members 48 which then retain lens tube 55 or 56 while permitting vertical adjustment and movement for focusing of the image. Alternate mechanisms for providing similar capability include the use of a resilient 0-ring between gobo holder 45 and lens tube 55 or 56. Other alternate methods of attachment also include a felt ring between the two tubular parts, and male and female mating screw threads.

FIG. 13 shows an exploded view of the gobo which fits in the upper end of gobo holder 45, followed by short lens tube 55, preferably a wide angle lens tube, which may contain a wide angle lens or longer lens tube 56, preferably a narrow angle lens tube, which are fitted over the lower portion of gobo holder 45. Prior to attaching short lens tube 55 or longer lens tube 56, desired filters 27, lens 24 and lens retainer 26 are inserted in the open end.

Figure 14:
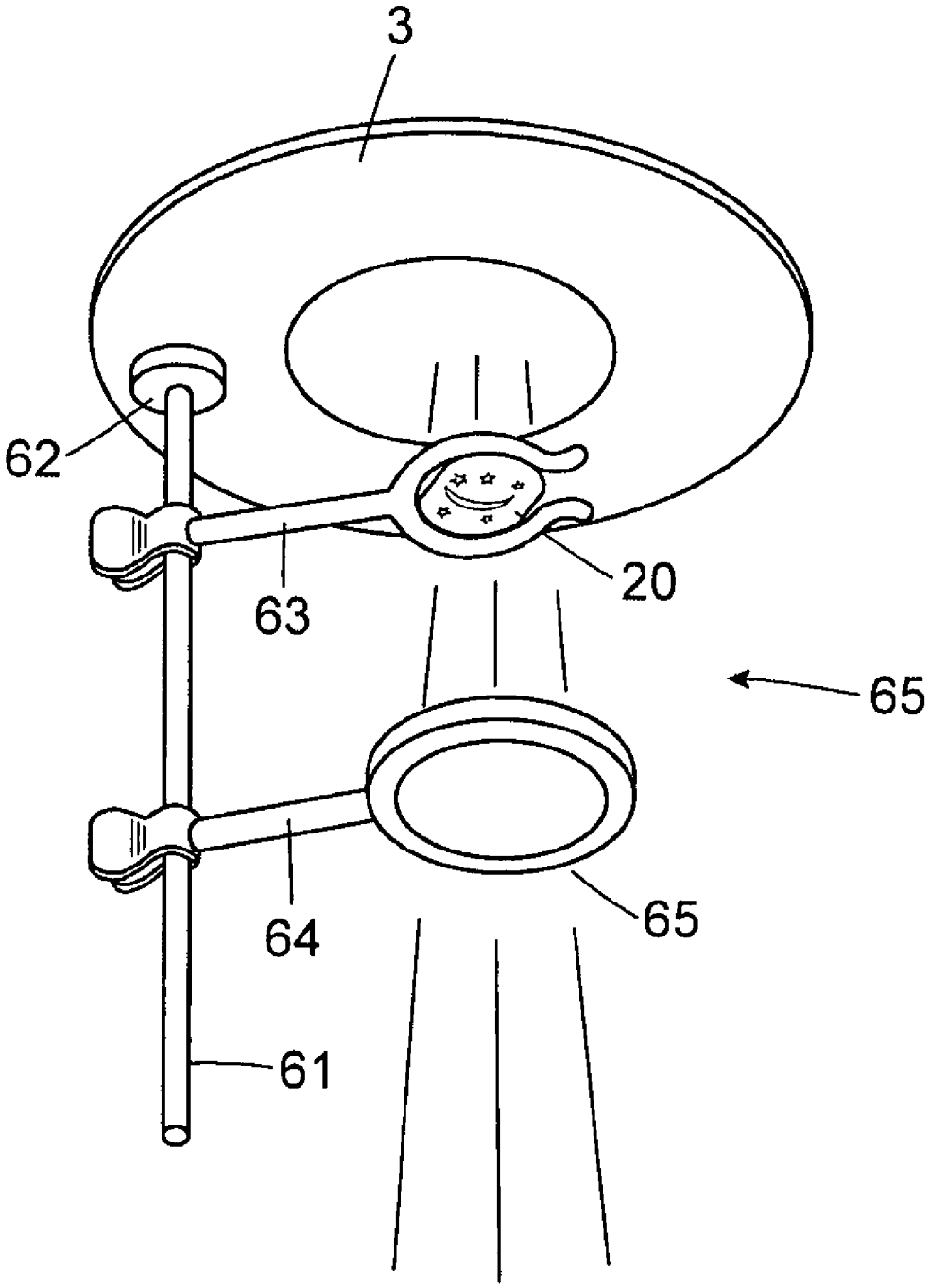
FIG. 14 is a perspective view of an alternate embodiment of this invention using a magnetically attached post with gobo arm and lens arm.

FIG. 14 shows an alternate embodiment of this invention 60. This projector accessory consists of post or rod 61 with powerful magnet 62 adhesively or otherwise attached at one end. Magnet 62 is used to locate and attach projector accessory 60 to trim 3 of an existing recessed lighting fixture. Arm 63 with a springy gobo holder at its distal end attaches to post 61 via a spring clip as shown or alternatively via a collar and thumb screw. Another arm, 64, is similarly attached to post 61 below arm 63; it carries lens 65 in a frame at its distal end. By control of the lengths of arms 63 and 64, the center distance relative to post 61 of lens 65 is made equal to the center of installed gobo 20. The position of magnet 62 is selected to place the center of trim 3 in registration with the center of gobo 20 and the center of lens 65. Both gobo 20 and lens 65 can be moved vertically along and rotated around post 61; therefore the projected image size and focus can be adjusted.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

We claim:

1. A light projector accessory for and in combination with a recessed lighting fixture comprising:

said recessed lighting fixture having a trim member;

said accessory having a base supporting at least one lens, at least one gobo and having a projectable design, and a mechanism for focusing an image produced by said gobo through said lens;

said base having a collar extending away from said recessed lighting fixture, light from said fixture passing through said base and collar;

means for removably attaching said base to said trim;

a gobo holder holding said gobo, said gobo holder having a first end for engaging said collar, said gobo holder having means for supporting said gobo within said gobo holder adjacent a distal end of said collar;

said focusing mechanism being a lens tube housing said at least one lens mounted on a second end of said gobo holder; and said base having a shoulder with leak light openings for allowing some light to bypass said gobo holder and lens tube.

2. The light projector as in claim 1 wherein said collar and said base are separate units attachable to each other.

3. The light projector as in claim 1 wherein said collar and said base are integrally provided in a single piece.

4. The light projector accessory of claim 1 in which said means for removably attaching said base to said trim comprises spring members joining said base to said trim member, each spring member being an elongated member with a hook at each end for engaging said trim member and base, respectively.

5. The light projector accessory of claim 1 in which said means for attaching said base to said trim comprises magnets mounted to said base adjacent an open end in contact with said trim member of said the first end of said recessed lighting fixture.

6. The light projector accessory of claim 1 in which said means for supporting said gobo within said gobo holder comprises an annular recess with a ring pressed into said recess for providing a shoulder on which said gobo rests.

7. The light projector accessory of claim 1 in which fasteners are provided with said gobo holder to engage and hold said lens tube while allowing said lens tube to be adjusted linearly and moved to focus a projected image formed from said gobo.

8. The light projector accessory of claim 1 in which said base and gobo holder have a quick bayonet attachment for easy mounting and removal of said gobo holder.

9. The light projector accessory of claim 1 in which said shoulder of said base has means for adjusting light passing through said leak light openings.

10. The light projector accessory as in claim 1 further comprising at least one color filter adjacent to said lens to tint the projected image.

11. The light projector accessory as in claim 1 wherein said lens tube is adjustable along said gobo holder to adjust focus of said image through said lens.

12. The light projector accessory as in claim 1 further comprising a mirror mounted adjacent a light outlet of said lens tube for directing light from said lighting fixture passing through said base, through said gobo inside of said gobo holder, and said lens, within said lens tube, to a wall or ceiling of a room in which said lighting fixture is located.

13. The light projector accessory of claim 12 in which said mirror has an attachment member extending therefrom, a distal end of said attachment member having a magnet for attaching to an outer wall of said lens tube, the bending of said mirror with respect to said distal end allowing a light beam to be redirected where desired.

* * * * *